United States Patent [19]

Randle

[11] Patent Number: 5,018,488

[45] Date of Patent: May 28, 1991

[54] HYDRAULIC TAPPETS

[75] Inventor: Steven J. Randle, Baginton, United Kingdom

[73] Assignee: Jaguar Cars Limited, United Kingdom

[21] Appl. No.: 514,090

[22] Filed: Apr. 25, 1990

[30] Foreign Application Priority Data

May 3, 1989 [GB] United Kingdom ..... 8910102

[51] Int. Cl.[5] ..... F01L 1/24

[52] U.S. Cl. ..... 123/90.55; 123/90.57

[58] Field of Search ..... 123/90.35, 90.48, 90.49, 123/90.52, 90.55, 90.57, 90.67

[56] References Cited

U.S. PATENT DOCUMENTS

| | | | |
|---|---|---|---|
| 3,704,696 | 12/1972 | Abell, Jr. | 123/90.55 |
| 3,941,102 | 3/1976 | Bareham | 123/90.52 |
| 4,321,894 | 3/1982 | Black | 123/90.54 |
| 4,365,595 | 12/1982 | Piatti | 123/90.53 |

FOREIGN PATENT DOCUMENTS

| | | | |
|---|---|---|---|
| 3023686 | 1/1982 | Fed. Rep. of Germany | 123/90.55 |
| 3718393 | 2/1987 | Fed. Rep. of Germany . | |
| 3704929 | 8/1988 | Fed. Rep. of Germany | 123/90.55 |
| 2068496 | 8/1981 | United Kingdom | 123/90.54 |

*Primary Examiner*—Charles J. Myhre
*Assistant Examiner*—Weilun Lo
*Attorney, Agent, or Firm*—Davis, Bujold & Streck

[57] ABSTRACT

A hydraulic tappet for an internal combustion engine has a collar located axially on a valve stem, the outer periphery of the collar slidably engaging a cylindrical bore which is coaxial with the valve stem. A cap having a central tubular formation which slidingly engages over the end of the valve stem and an outer periphery which engages the cylindrical bore, is separated axially of the collar, to define a first chamber between the cap and collar and a second chamber between the cap and the end of valve stem. An inlet for hydraulic fluid is provided to the first chamber and the first and second chambers one interconnected by a non-return valve which prevents flow from the second chamber. A controlled leakage path is provided from the second chamber and a spring biases the cap into engagement with a cam formation.

8 Claims, 1 Drawing Sheet

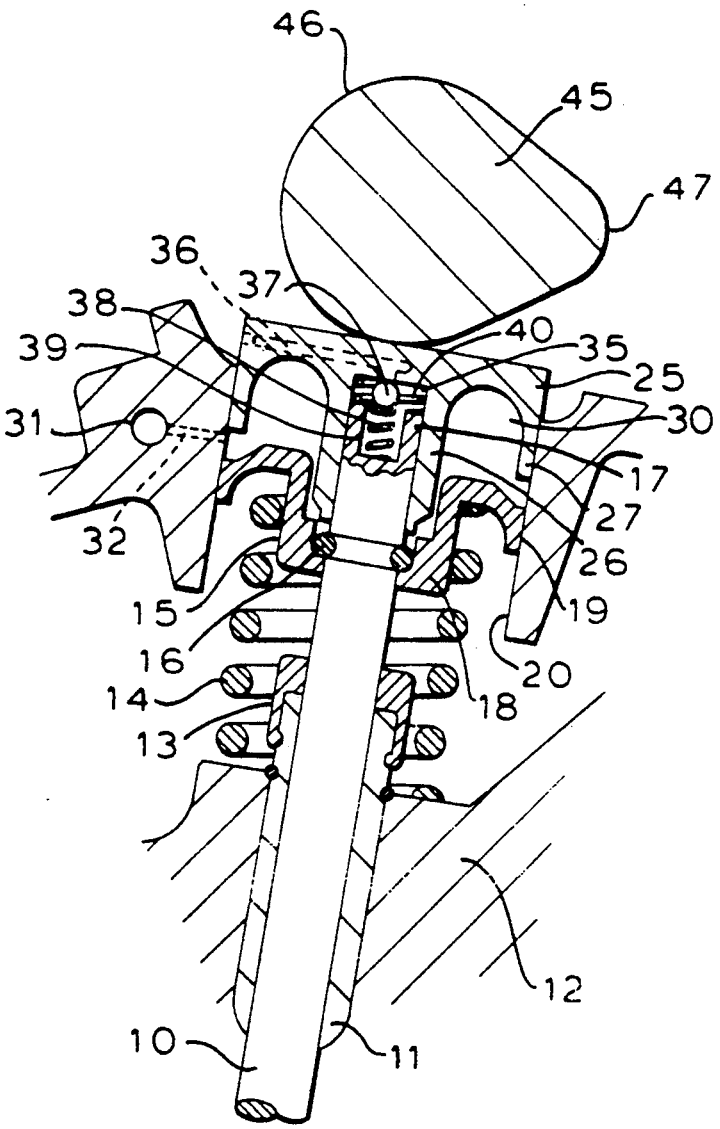
46
45
47
36
37
38
39
40
35
25
31
30
17
27
32
26
15
19
16
20
14
18
13
12
10
11

HYDRAULIC TAPPETS

BACKGROUND OF THE INVENTION

The present invention relates to hydraulic tappets and in particular hydraulic tappets for overhead cam shaft internal combustion engines.

In conventional overhead cam shaft internal combustion engines, a cup shaped tappet is located over the end of the valve stem with an adjusting shim interposed therebetween. The tappet is slidingly located in a bore in the cylinder head, so that the flat face thereof is engaged by a cam. In order to ensure that the valve will close fully in spite of thermal expansion of the components, it is necessary to maintain a clearance between the face of the tappet and the base circle diameter of the cam. The thickness of the adjusting shim is selected to provide a set clearance between the face of the tappet and the base circle diameter of the cam, so that a clearance will be maintained therebetween, over the operating temperature range of the engine, while noise created thereby is minimized.

The present invention provides a hydraulic tappet in which the inter-engaging surfaces of the cam and tappet are maintained in engagement, a clearance being provided between the tappet and valve stem, the load applied to the tappet being transmitted to the valve stem by means of hydraulic fluid.

SUMMARY OF THE INVENTION

According to one aspect of the present invention, a hydraulic tappet for an internal combustion engine comprises a collar located axially on a valve stem, the outer periphery of the collar slidably engaging a cylindrical bore which is coaxial with the valve stem, a cap having a central tubular formation which slidingly engages over the end of the valve stem, the outer periphery of the cap slidably engaging the cylindrical bore, the cap being axially separated from the collar, a first chamber being defined between the cap and collar and a second chamber being defined between the cap and end of the valve stem, an inlet for hydraulic fluid being provided to the first chamber and the first chamber being interconnected to the second chamber via a non-return valve which prevents flow of hydraulic fluid from the second chamber, a controlled leakage path being provided from the second chamber and means being provided to bias the cap into engagement with a cam formation.

With this assembly, hydraulic fluid is supplied at relatively low pressure to the first chamber from, for example, the engine oil pressure supply. When the cap is engaged by the base circle of the cam, the second chamber is filled with oil which is permitted to flow past the non-return valve from the first chamber. When the cam lobe engages the cap and urges it towards the valve stem, fluid in the second chamber is prevented from returning to the first chamber by the non-return valve and thus transmits the load to the valve stem causing the valve to open. During movement of the valve, the fluid in the second chamber which is at high pressure, is permitted to leak slowly through the controlled leakage path, so that when the valve again closes, the cap will have moved slightly towards the collar to provide a clearance between the cap and base circle of the cam. This clearance is taken up by the biasing means acting on the cap, so that more fluid is drawn from the first chamber into the second.

The present invention provides a hydraulic tappet of substantially the same dimensions as the conventional tappets used hitherto. These hydraulic tappets will not consequently significantly increase the overall height of the engine and will require minimal modifications to the design of the cylinder head. To this end, the collar located on the valve stem will preferably also serve as a reaction element for the valve spring, against which the valve spring will act to bias the valve to its closed position.

BRIEF DESCRIPTION OF THE DRAWING

An embodiment of the invention is now described, by way of example only, with reference to the accompanying drawing which illustrates in sectional elevation a hydraulic tappet in accordance with the present invention.

DESCRIPTION OF A PREFERRED EMBODIMENT

As illustrated in the accompanying drawing, a valve stem 10 is slidingly located in a valve guide 11 which is secured in a bore passing through the cylinder head 12. The valve stem 10 is sealed with respect to the guide 11 by means of the seal 13 which prevents oil from leaking down the valve stem 10 into the combustion chamber.

A collar 15 is located axially on the valve stem 10 by means of a circlip 16. The valve return spring 14 acts between the cylinder head 11 and the collar 15 urging the collar 15 into engagement with the circlip 16 and the valve to its closed position.

The collar 15 is of generally top hat section, the central cupped portion 18 extended coaxially of the valve stem 10 towards the end 17 thereof which is remote from the valve head. A cylindrical flange 19 is provided about the outer periphery of collar 15, this flange 19 extending parallel to the valve stem 10 towards the valve head. The flange 19 slidably engages a cylindrical bore 20 formed in the cylinder head 12.

A cap 25 has a tubular central portion 26 which is slidably engaged on the end 17 of the valve stem 10 and extends within the cupped portion 18 of collar 15. The cap 25 has a cylindrical flange formation 27 about its periphery, this flange formation 27 extending coaxially of the valve stem 10 and slidingly engaging the cylindrical bore 20. The cap 25 and collar 15 are spaced axially of one another and, with the cylindrical bore 20 define a first chamber 30. The chamber 30 is connected to the engine oil supply by means of bores 31 and 32.

A second chamber 35 is defined between the cap 25 and end 17 of valve stem 10. A bore 36 is provided through the cap 25 to connect chamber 35 to chamber 30. A ball valve 37 is provided in chamber 35 and is biased to close the passage 36, by means of a light spring 38 which is located in a counter-bore 39 in the valve stem 10. A further spring 40 acts between the end of valve stem 10 and cap 25, biasing them apart and the cap into engagement with a cam 45.

In operation, when the base circle 46 of the cam 45 engages the face of cap 25, the spring 40 will urge the cap 25 into engagement with the cam 45. Oil at a pressure of the order of 60 psi is supplied by means of the engine oil pump through bores 31 and 32 to the chamber 30. This oil is fed through bore 36, past ball valve 37 to fill the chamber 35, the ball valve 37 being unseated against the load applied by spring 38 by the pressure of the oil.

When the cam lobe 47 engages the cap 25 to move it downwardly, the ball valve 37 will prevent oil flowing out of chamber 35 through the bore 36. Movement of the cap 25 is consequently transmitted to the valve stem 10 to open the valve, by means of the oil in chamber 35.

During movement of the valve, oil in chamber 35 which is now at a significantly higher pressure, leaks between the engaging surfaces of the tubular portion 26 of cap 25 and the valve stem 10, so that the cap 25 will move slightly, relative to the valve stem 10, towards collar 15. As a result of this movement, when the lobe 47 of the cam 45 moves out of engagement with the face of cap 25 and the valve is closed, there will be a slight clearance between the cap 25 and base circle 46 of the cam 45. The spring 40 will however maintain the cap 25 in engagement with the cam 45 and more oil will be drawn into the chamber 35 from chamber 30. The controlled leakage of fluid from chamber 35 will allow for adjustment of the mechanism to accommodate increase in length of the components, particularly the valve stem 10, due to thermal expansion.

It is not necessary to seal the collar 15 and cap 25 with respect to the cylindrical bore 20, provided that there is sufficient throttling to maintain a pressure of oil in the chamber 30 sufficient to overcome the force of the spring 38 and feed oil into the chamber 35. Some leakage past these surfaces is in fact desirable, for lubrication purposes.

The cap 25 of the present invention is primarily guided by means of the valve stem 10 and the flange formation may consequently be much shallower than that of a conventional tappet which relies on engagement of this surface with the guiding bore for guidance. The cylindrical bore 20 of the present invention may consequently be of similar dimension to that of the conventional tappet guiding bore and hence the overall height of the assembly need not be significantly greater than that of a conventional tappet.

Various modifications may be made without departing from the invention. For example, while in the above embodiment fluid is permitted to leak in controlled manner between the tubular portion 26 of the cap 25 and the valve stem 10, a throttled output port may be provided for this purpose. Furthermore, while a spring 40 is provided to bias the cap 25 into engagement with the cam 45, the pressure of oil from the engine pump in chambers 30 and 35 will produce a biasing force and the spring 40 may be omitted.

I claim:

1. A hydraulic tappet for an internal combustion engine comprising a collar located axially on a valve stem, the outer periphery of the collar slidably engaging a cylindrical bore which is coaxial with the valve stem, a cap having a central tubular formation which slidingly engages over the end of the valve stem, the outer periphery of the cap slidably engaging the cylindrical bore, the cap being axially separated from the collar, a first chamber being defined between the cap and collar and a second chamber being defined between the cap and the end of the valve stem, an inlet for hydraulic fluid being provided to the first chamber and the first chamber being interconnected to the second chamber via a non-return valve which prevents flow of hydraulic fluid from the second chamber, a controlled leakage path being provided from the second chamber and means being provided to bias the cap into engagement with a cam formation.

2. A hydraulic tappet according to claim 1 in which the collar has a cupped central portion which extends away from the cap, the tubular portion of the cap extending coaxially into the cupped portion of the collar.

3. A hydraulic tappet according to claim 1 in which the collar serves as a reaction element for the valve return spring.

4. A hydraulic tappet according to claim 1 in which oil is supplied to said first chamber from an engine driven pump.

5. A hydraulic tappet according to claim 1 in which the non-return valve comprises a ball valve, the ball being urged to close the passage between the first and second chambers by means of a light spring.

6. A hydraulic tappet according to claim 5 in which the ball is located in the second chamber, the spring being located in a counter-bore in the end of the valve stem.

7. A hydraulic tappet according to claim 1 in which the controlled leakage path from the second chamber is defined by the opposed surfaces of the tubular portion of the cap and the valve stem.

8. A hydraulic tappet according to claim 1 in which a spring acts between the end of the valve stem and the cap to bias the cap into engagement with the cam.

* * * * *